US006828997B2

(12) United States Patent
Sasaki et al.

(10) Patent No.: US 6,828,997 B2
(45) Date of Patent: Dec. 7, 2004

(54) IMAGE RECORDING METHOD AND IMAGE RECORDING APPARATUS

(75) Inventors: Yoshiharu Sasaki, Shizuoka (JP); Toshiharu Tanaka, Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/337,667

(22) Filed: Jun. 22, 1999

(65) Prior Publication Data

US 2002/0135660 A1 Sep. 26, 2002

(30) Foreign Application Priority Data

Jun. 30, 1998 (JP) ..... 10-184721

(51) Int. Cl.[7] ..... B41J 2/435
(52) U.S. Cl. ..... 347/227; 347/262; 347/264
(58) Field of Search ..... 347/227, 262, 347/264, 171, 172, 244, 217; 399/133; 356/381, 382

(56) References Cited

U.S. PATENT DOCUMENTS 4,269,491 A * 5/1981 Hagyuda ..... 354/25
4,527,171 A * 7/1985 Takanashi et al. ..... 347/217 X
5,196,866 A * 3/1993 Ferschl et al. ..... 347/242
5,258,776 A * 11/1993 Guy et al. ..... 347/237
5,397,763 A * 3/1995 Fujimura et al. ..... 503/227
5,578,824 A * 11/1996 Koguchi et al. ..... 250/318
6,204,874 B1 * 3/2001 Michelson ..... 347/176

* cited by examiner

*Primary Examiner*—Hai Pham
(74) *Attorney, Agent, or Firm*—Sughrue Mion, PLLC

(57) ABSTRACT

An image recording method includes the steps of attaching recording paper on an outer peripheral surface of a recording drum, attaching an image receiving sheet having an image receiving layer on the recording paper to transfer the image receiving layer thereon, attaching a toner sheet on the image recording sheet, and transferring toner of the toner sheet onto the image receiving layer in accordance with recording data.

8 Claims, 9 Drawing Sheets

IMAGE RECORDING METHOD AND IMAGE RECORDING APPARATUS

BACKGROUND OF THE INVENTION

The present invention relates to an image recording method and an image recording apparatus for recording information such as images, characters, etc. on recording paper, and particularly to a technique for attaining reliable recording while simplifying an image recording step using an image receiving sheet and a toner sheet.

A transfer type image recording apparatus has such a configuration that recording materials such as an image receiving sheet, a toner sheet and so on to be used are stacked and attached on a rotating recording drum and the recording materials are irradiated with laser light in accordance with inputted character/image data so that image recording is performed.

An image recording process in such an image recording apparatus will be described with reference to FIGS. 14(*a*) to (*f*) showing an example of recording process for the respective colors of K (black), C (cyan), M (magenta) and Y (yellow). Each process for the four colors K, C, M and Y is constituted by a step of performing laser recording with corresponding color data, and a step of separating a toner sheet from an image receiving sheet thereafter. When laminating is performed, a laminating step will be inserted before each step of laser recording. The respective steps will be described below sequentially.

An image receiving sheet 5 is wound on a recording drum 2 as shown in FIG. 14(*a*).

A K-toner sheet 6 is wound on the image receiving sheet 5 as shown in FIG. 14(*b*) in order to execute a K-process.

Laser light is radiated in accordance with image/character data of K so as to perform recording as shown in FIG. 14(*d*).

The K-toner sheet 6 is separated from the image receiving sheet 5 as shown in FIG. 14(*e*) (the K-process is terminated).

Next, a C-process is executed. That is, a C-toner sheet is wound on the image receiving sheet in the same manner as in the K-process.

Laser recording is performed in accordance with C-data.

The C-toner sheet is separated from the image receiving sheet (the C-process is terminated).

Next, an M-process is executed. That is, an M-toner sheet is wound on the image receiving sheet in the same manner as in the K-process.

Laser recording is performed in accordance with M-data.

The M-toner sheet is separated from the image receiving sheet (the M-process is terminated).

Next, a Y-process is executed. That is, a Y-toner sheet is wound on the image receiving sheet in the same manner as in the K-process.

Laser recording is performed in accordance with Y-data.

The Y-toner sheet is separated from the image receiving sheet (the Y-process is terminated).

In such a manner, the four colors K, C, M and Y are put one on another or not put on the image receiving sheet properly so as to form a desired color image as shown in FIG. 14(*f*).

The color image formed through the above process is transferred to recording paper (not shown).

In the case where laminating processing is required, the toner sheet is pressed by a press roller, a heating roller or the like immediately before laser recording in each color so as to be put into tight contact with the image receiving sheet as shown in FIG. 14(*c*).

However, in the above-mentioned recording process, the image receiving sheet is detached from the image recording apparatus after image recording of the four colors K, C, M and Y is performed on the image receiving sheet, and then the image receiving sheet is attached to another apparatus so that an image on the image receiving sheet is transferred to recording paper. Therefore, there has been a problem that during the transfer, there is an increased possibility that the recording material will become damaged or stained with dust when the image receiving sheet is detached from the image recording apparatus. This causes lowering of the quality of the recording material. A step of transferring the image to recording paper by another apparatus, that is, a step of detaching the recording material from the image recording apparatus and attaching it to a transfer apparatus is required in addition to the image recording step. Therefore, there has been a problem that the number of steps working increase so that the cost increases.

In addition, generally, there is a slight variation in the thickness of recording paper in accordance with a location of the recording paper. This variation occasionally influences the image quality. That is, the height of the image receiving sheet and the toner sheet which are attached to the recording drum through the recording paper from the drum surface varies in accordance with the thickness of the recording paper. On the other hand, an optical head for emitting laser light has a fixed focus. Accordingly, when the thickness of the recording paper varies, the focal position of the laser light may be out of its proper position, so that the laser light spot is extended. As a result, there has been a problem that the resolution of a recorded image deteriorates so that the image quality deteriorates.

SUMMARY OF THE INVENTION

It is therefore an object of the present invention to provide an image recording method and an image recording apparatus in which not only an image recording process can be simplified to improve the productivity, but also image recording on recording paper can be performed accurately and stably with high quality.

In order to achieve the above object, according to the present invention, there is provided an image recording method comprising the steps of:

- attaching recording paper on an outer peripheral surface of a recording drum;
- forming an image receiving layer on a surface of the recording paper; and
- transferring the toner on a toner sheet onto the image receiving layer to record an image thereon in accordance with recording data.

In this image recording method, recording is performed by selectively transferring toner to the image receiving layer on the recording paper in accordance with the recording data. Therefore, an image is recorded on the recording paper directly, so that the image recording process is simplified.

According to the present invention, a cushion layer is formed between the surface of the recording drum and the image receiving layer.

In this image recording method, a cushion layer is formed under the image receiving layer on the recording paper, so that the cushion layer sinks in accordance with the thickness of toner and the surface to which the toner is transferred is made flat. Accordingly, it is possible to improve the adherence of the toner, and it is possible to prevent toner from separating after transfer, so that image recording can be realized with higher quality.

According to the present invention, the receiving layer is formed by attaching an image receiving sheet having the image receiving layer on the surface of the recording paper and then transferring the image receiving layer thereon.

In this image recording method, the recording paper and the image receiving sheet are attached subsequently on the outer circumferential surface of the recording drum, and the image receiving layer of the image receiving sheet is transferred to the outer circumferential surface of the recording paper. The toner sheet is further wound thereon, and toner is thermally transferred to the recording paper directly in accordance with the recording image data to thereby record an image thereon. Accordingly, image recording onto the recording paper is performed directly, stably and more accurately. In addition, the image receiving sheet in which an image has been formed is not required to be detached from the image recording apparatus and transferred to the recording paper again. It is therefore possible to simplify the image recording process.

According to the present invention, the image receiving sheet includes a cushion layer therebeneath, and the image receiving layer is transferred such that the cushion layer is placed between the surface of the recording paper and the receiving layer.

In this image recording method, a cushion layer is formed in the image receiving sheet, and is transferred to the recording paper. It is therefore possible to form a cushion layer in the recording paper easily.

According to the present invention, a protective layer is formed on an image recorded surface on the recording paper.

In this image recording method, a protective layer is provided on the image recorded surface after the toner is transferred, so that the recorded toner or the recording paper itself is protected from external damage. It is therefore possible to prevent image quality from deteriorating as much as possible after recording.

According to the present invention, the toner sheet includes a light-heat conversion layer, and the toner is thermally transferred by irradiating laser beam onto the light-heat conversion layer.

In this image recording method, thermal transfer is performed by use of laser light, so that it is possible to record image data faithfully at a high speed. It is therefore possible to perform high-quality image recording easily.

According to the present invention, the image recording method further comprises the steps of: measuring thickness of the recording paper by thickness detecting means; and adjusting focal point of the laser beam in accordance with the measured value of the thickness detecting means.

In this image recording method, it is possible to correct the displacement of the focal position of the laser light caused by variation of the thickness of recording paper which is generally uneven. It is therefore possible to perform high-quality image recording stably without reducing the resolution of the recorded image.

According to the present invention, a non-contact type displacement meter is used as the thickness detecting means.

In this image recording method, it is possible to detect the thickness easily and accurately at a high speed.

According to the present invention, a laser displacement meter is used as the thickness detecting means.

In this image recording method, the laser displacement meter is used for detecting the thickness of the recording paper, so that the information of the thickness can be obtained accurately through the laser displacement meter is of the non-contact type. In addition, the response speed of the meter is so high that it is possible to terminate the thickness detection quickly. In addition, it is also possible to correct the focal position while performing the thickness detection.

According to the present invention, the thickness of the recording paper is measured from a position opposite to the rotating direction of the recording drum, and the focal position of the laser beam is adjusted in real time.

In this image recording method, the time lag between the time to detect the thickness and the time to analyze the detection result can be canceled. Accordingly, it is possible to adjust the focal position in real time and thereby it is possible to perform image recording quickly without increasing the time for recording an image.

Alternatively, the measured value of the thickness detecting means with respect to all the predetermined detection area may be once stored in memory means. The focal point of the laser beam is subsequently adjusted in accordance with the stored value.

According to the present invention, there is provided an image recording apparatus for recording an image by use of any one the above image recording methods.

In this image recording apparatus, it is possible to perform image recording, so that it is possible to simplify the image recording process and improve the productivity, and it is possible to perform high-quality image recording onto the recording paper stably and accurately.

DETAILED DESCRIPTION OF THE PREFERRED EMBODIMENTS

Embodiments of an image recording apparatus according to the present invention will be described below with reference to the accompanying drawings.

First, a first embodiment of an image recording apparatus according to the present invention will be described with reference to FIGS. 1 to 9. In this embodiment, an image receiving layer is formed on the surface of recording paper so that toner is thermal transferred thereon directly.

Figure 1:
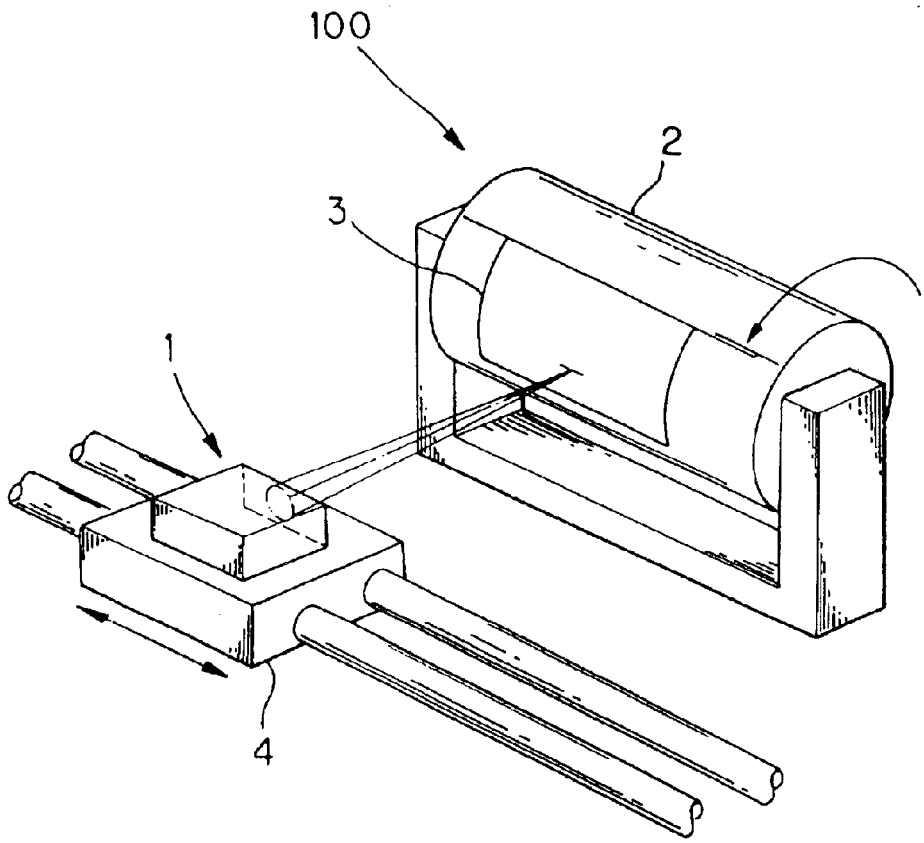
FIG. 1 is a schematic perspective view showing the configuration of an essential part of an image recording apparatus to which the present invention has been applied.
Figure 2:
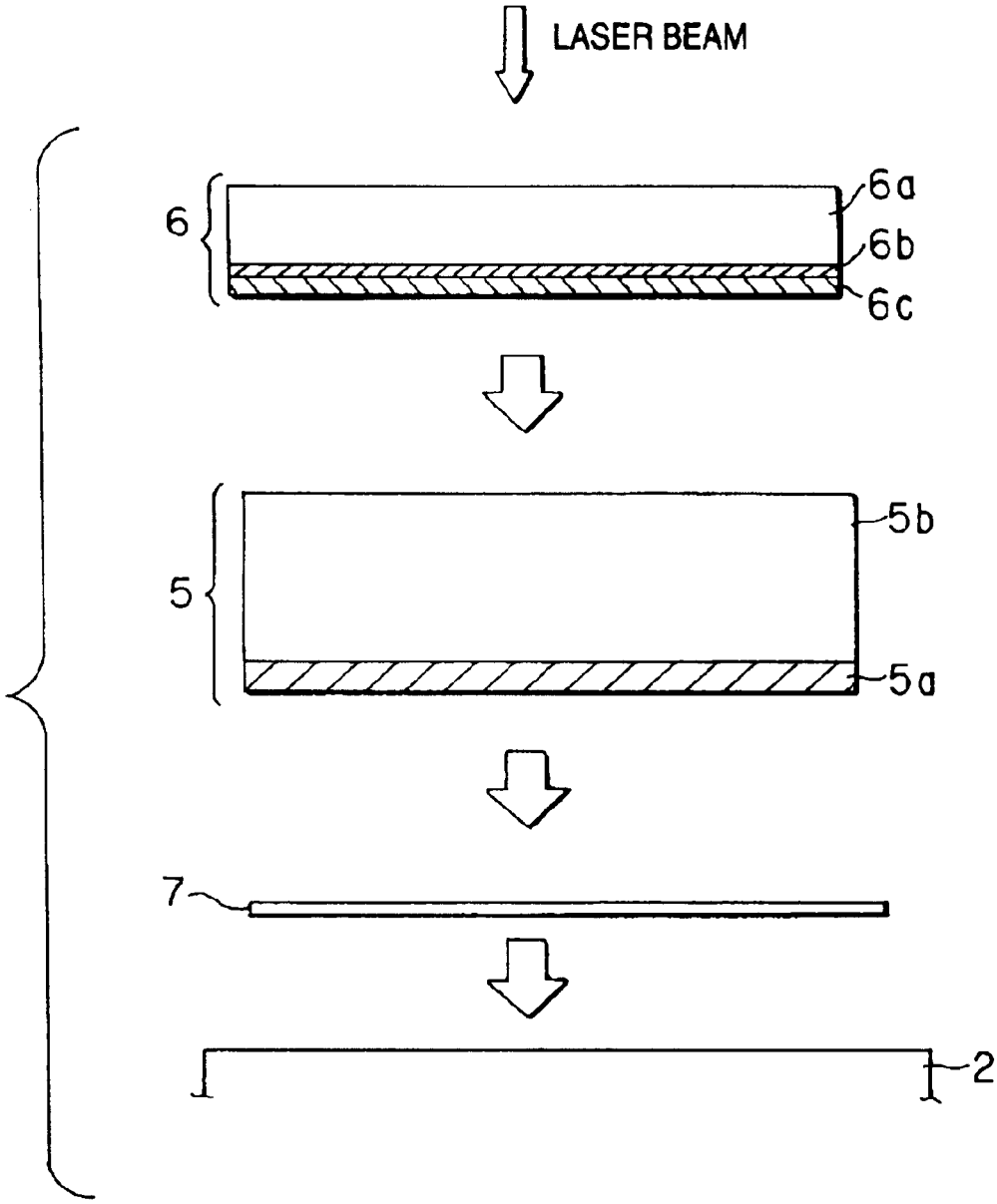
FIG. 2 is a sectional view showing the order in which an image receiving sheet and a toner sheet are attached to a recording drum.

FIG. 1 is a schematic perspective view illustrating the whole configuration of the image recording apparatus, and FIG. 2 is a sectional view showing the order in which an image receiving sheet and a toner sheet used for image recording are attached to a rotative recording drum.

This image recording apparatus has such a configuration as follows, by way of example. The image recording apparatus comprises:

(1) an optical head having a plurality of laser beam sources subjected to ON/OFF-modulation in accordance with recording data, and being capable of moving relatively to the rotation axis of a recording drum and in a direction parallel therewith (the optical head may be fixed, while the recording drum may be made to move transversely, so that the subscanning is established);

(2) a rotatable recording drum to which recording materials (recording paper, an image receiving sheet and a toner sheet) are attached; and (3) a recording material which is constituted by an image receiving sheet and toner sheets of respective colors K, C, M and Y (other toner sheets of special colors such as gold, silver, blown, gray, orange, green, etc. may be optionally used) and which is able to be transferred with laser light.

FIG. 1 is a perspective view showing the configuration of an essential part of an image recording apparatus 100. The image recording apparatus 100 comprises: an optical head 1 which has a plurality of laser beam sources subjected to ON/OFF-modulation in accordance with recording data, and which is capable of moving relatively to the rotation axis and in a direction parallel therewith; and a rotative recording drum 2 which is pivotally supported and outer circumferential surface of which a recording material 3 is attached.

The optical head 1 is mounted on a stage 4 which is made to move in parallel with the recording drum 2. This movement corresponds to the direction of subscanning when an image is to be recorded. The direction of main scanning is the direction of rotation of the recording drum 2.

Next, the specific structures of the image receiving sheet and the toner sheet will be described with reference to FIG. 2. FIG. 2 shows the configurations of an image receiving sheet 5 and a toner sheet 6, and the order in which the respective sheets and recording paper 7 are attached to the recording drum 2.

The image receiving sheet 5 is constituted by an image receiving layer 5*a* and a substrate 5*b* in the order from the recording drum 2 side. On the other hand, the toner sheet 6 is constituted by a substrate 6*a*, a light-heat conversion layer 6*b* and a toner layer 6*c* in the order from the laser light irradiation side.

In this embodiment, recording paper 7 is attached on the surface of the recording drum 2, and the image receiving sheet 5 is attached thereon so that the image receiving layer 5*b* faces downside. Next, after the substrate 5*a* of the image receiving sheet is separated, the toner sheet 6 is attached on the image receiving sheet 5 so that the toner layer 6*c* is located on the image receiving layer 5*a* side. When laser light is irradiated onto the toner sheet 6 in this state, the toner layer portion irradiated with the laser beam is transferred by heat to the image receiving layer 5*a*.

Here, as the substrate 6*a*, a substrate which can transmit laser light such as a PET (polyethylene terephthalate) substrate, a TAC (triacetylcellulose) substrate, a PEN (polyethylene naphthalate) substrate, or the like, may be used.

On the other hand, for the light-heat conversion layer 6*b*, material which can convert laser energy into heat efficiently, such as carbon, black substance, infrared ray absorbing pigment, specific wavelength absorbing material, or the like, may be used.

As the toner layer 6*c*, toner sheets of respective colors of K, C, M and Y are used. Other toner sheets of gold, silver, brown, gray, orange, green, etc. may be used as mentioned above. The image receiving layer 5*a* has a function to receive the transferred toner 6*c*.

The image receiving sheet 5 and the toner sheet 6 is described in detail in Unexamined Japanese Patent Publication Nos. 4-296594A, 4-327982A, and 4-327983A, and an image recording apparatus having such a configuration is described in detail in Unexamined Japanese Patent Publication No. 6-275183A. See these publications if necessary.

Next, a process for attaching the recording paper, the image receiving sheet and the toner sheet to the image recording apparatus and recording an image will be described.

FIGS. 3 to 8 are views showing an example of a recording process for the respective colors of K, C, M and Y. Schematically, the recording process is constituted by a step of attaching a toner sheet of each color, a step of performing laser recording in accordance with data of the color, and a step of separating the toner sheet from the image receiving sheet after recording. If laminating is performed, a laminating step is inserted before the laser recording step. The respective steps will be described below sequentially.

Figure 3:
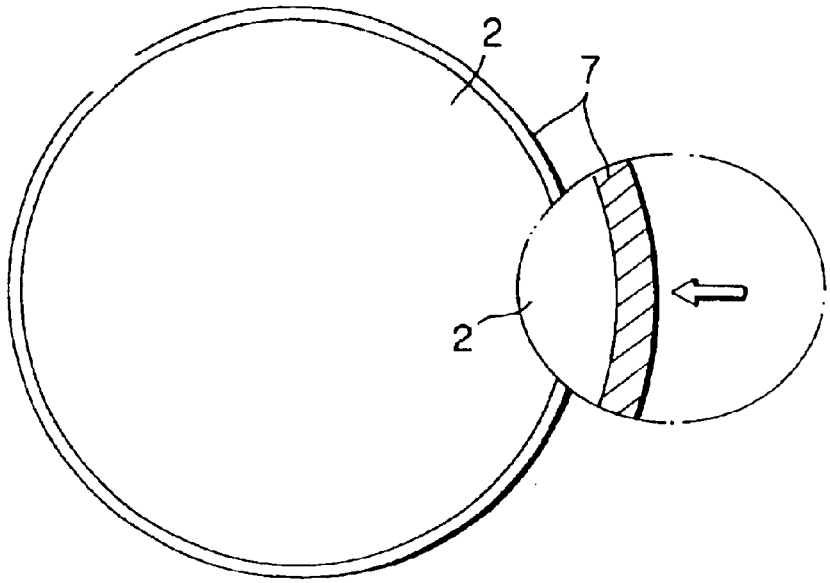
FIG. 3 is a schematic sectional view showing a step of attaching the recording paper to the recording drum.

1) As shown in FIG. 3, the recording paper 7 is wound and attached on the recording drum 2. An end portion of the recording paper 7 is engaged with the recording drum 2 by a fixing member (not shown). Alternatively, the recording paper 7 may be fixed by a method to suck the recording paper 7 through a suction hole formed on the recording drum 2, or by a method to attract the recording paper 7 electrostatically.

Figure 4:
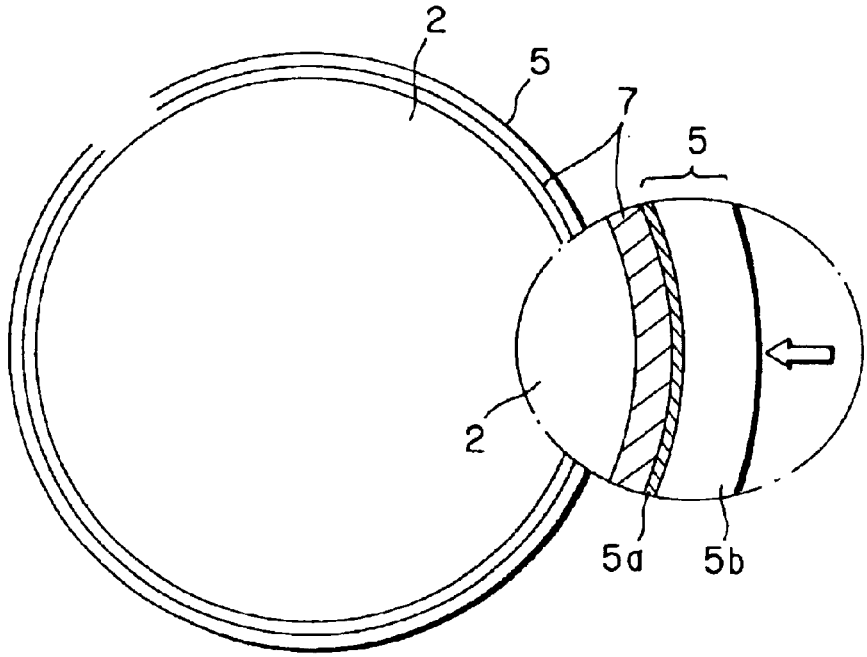
FIG. 4 is a schematic sectional view showing a step of attaching the image receiving sheet.

2) Next, the image receiving sheet 5 is wound on the recording paper 7 as shown in FIG. 4. In this embodiment, the image receiving sheet 5 is attached so that the substrate 5*b* is located outside and the image receiving layer 5*a* is in contact with the surface of the recording paper 7. Then, since the surface of the image receiving layer 5*a* has adherence, the recording paper 7 and the image receiving sheet 5 are bonded integrally with each other.

Figure 5:
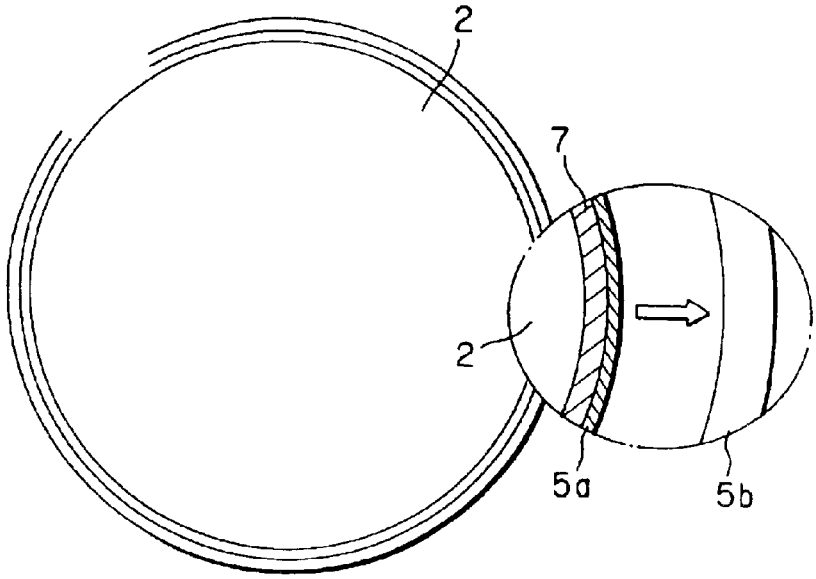
FIG. 5 is a schematic sectional view showing a step of separating a substrate of the image receiving sheet.

3) Next, the substrate 5*b* of the image receiving sheet 5 is separated from the image receiving layer 5*a* as shown in FIG. 5 so that only the image receiving layer 5*a* is transferred onto the recording paper 7.

Figure 6:
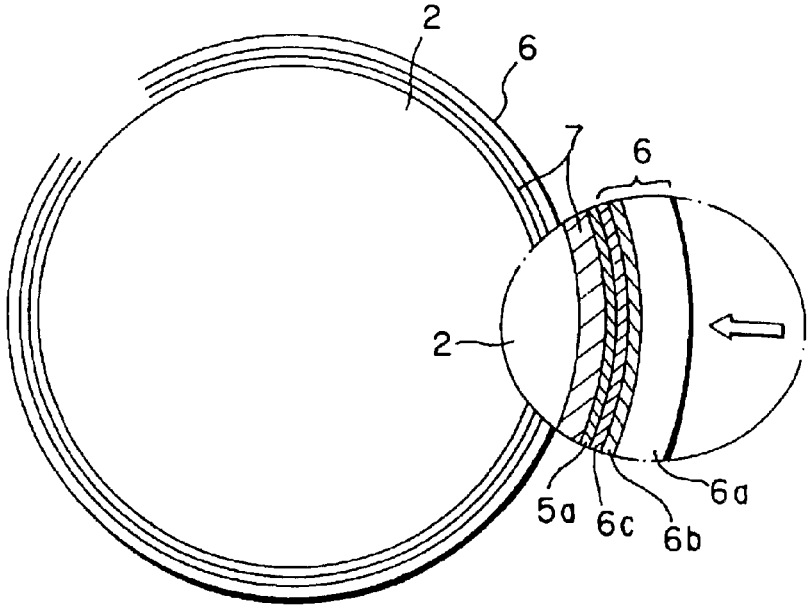
FIG. 6 is a schematic sectional view showing a step of attaching the toner sheet.

4) The toner sheet 6 is wound on the image receiving layer 5*a* as shown in FIG. 6. At this time, the toner sheet 6 is attached so that the substrate 6*a* is located outside and the toner layer 6*c* of the toner sheet 6 is in contact with the image receiving layer 5*a* of the image receiving sheet 5.

Figure 7:
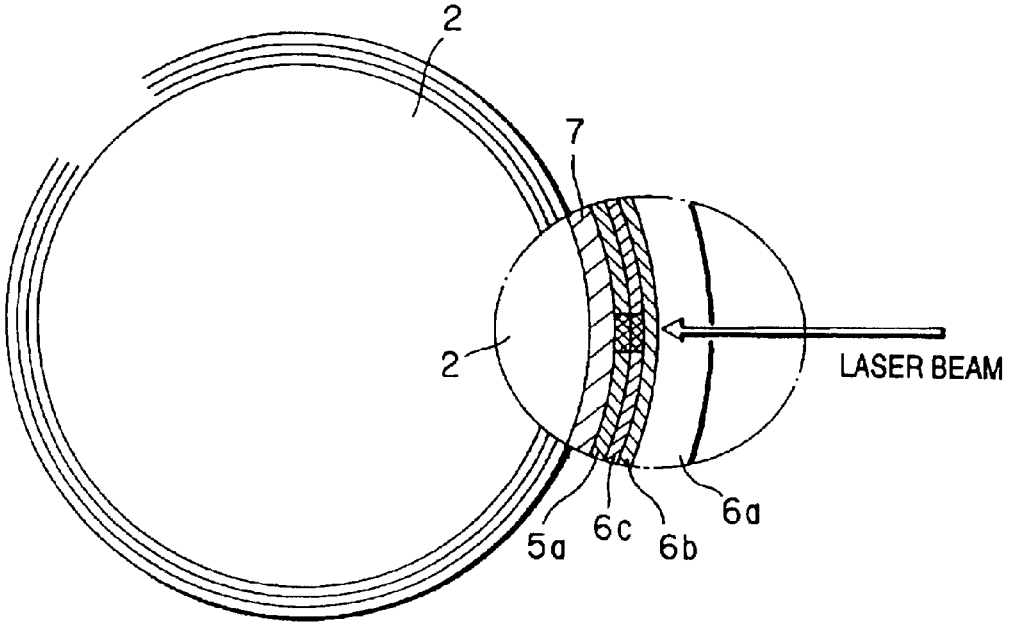
FIG. 7 is a schematic sectional view showing a step of irradiating laser light.

5) In this state, first, in accordance with inputted character/image data of K, laser light is irradiated as shown by the arrow in FIG. 7 to perform recording.

Figure 8:
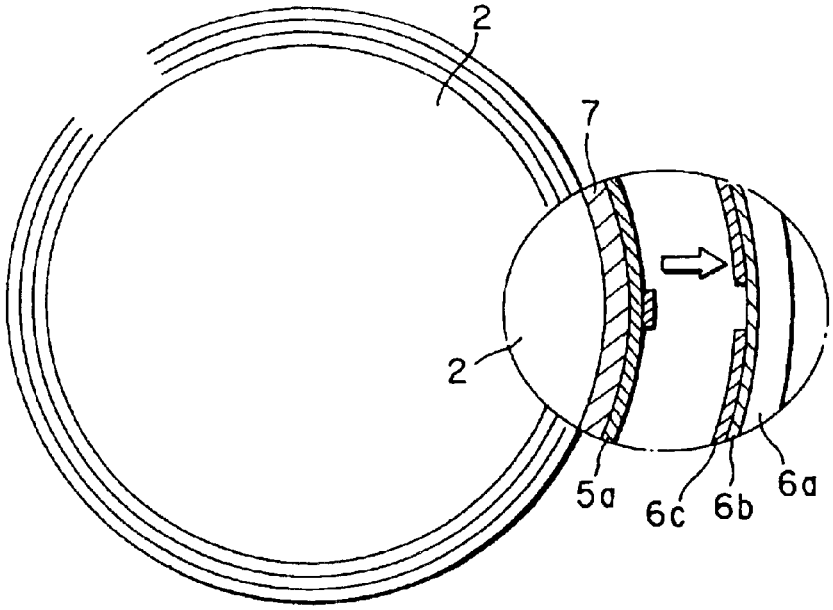
FIG. 8 is a schematic sectional view showing a step of separating the toner sheet.

6) The K-toner sheet 6 is separated from the image receiving layer 5*a*, and the substrate 6*a*, the light-heat conversion layer 6*b* and the toner layer 6*c* not subjected to irradiation with the laser light are eliminated. As a result of this step, the toner layer 6*c* in the portion irradiated in accordance with the character/image data is left in the image receiving layer 5*a* as shown in FIG. 8 so as to be formed into a K-image. Then the K-process is terminated.

7) Next, a C-process is executed. First, a C-toner sheet is wound on the upper surface of the image receiving layer 5*a*, that is, on the image receiving layer 5*a* in the state where the toner sheet has been separated as shown in FIG. 8, in the same manner as the K-toner sheet.

8) Laser recording is performed in accordance with C-data.

9) The C-toner sheet is separated from the image receiving layer 5*a* (the C-process is terminated).

10) Next, an M-process is executed. That is, an M-toner sheet is wound on the upper surface of the image receiving layer 5*a*.

11) Laser recording is performed in accordance with M-data.

12) The M-toner sheet is separated from the image receiving layer 5*a* (the M-process terminates).

13) Next, a Y-process is executed. That is, a Y-toner sheet is wound on the upper surface of the image receiving layer 5*a*.

14) Laser recording is performed in accordance with Y-data.

15) The Y-toner sheet is separated from the image receiving layer 5*a* (the Y-process terminated).

Figure 9:
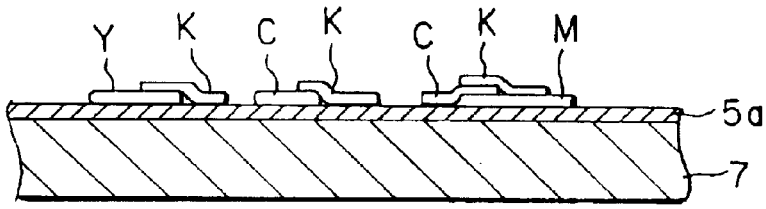
FIG. 9 is a sectional view showing a state after thermal transfer of four colors K, C, M and Y.

16) In such a manner, the four colors K, C, M and Y are put one on another or not put on the image receiving layer 5*a* properly to thereby form a desired color image as shown in FIG. 9.

As has been described above, in this embodiment, the image receiving layer 5*a* is first transferred to the recording paper 7, and toner of the respective colors is put on this thermal transferred image receiving layer 5*a* sequentially. Accordingly, substantially, toner of each color is put on the recording paper directly for recording. For example, it is therefore possible to record a desired image on the recording paper stably and accurately. It is therefore possible to perform image recording onto the recording paper efficiently without an image transfer process for transferring the image to the recording paper manually after a full-color toner image is formed. In addition, it is not necessary to detach the recording paper with toner put one on another from the image recording apparatus and attach it to another apparatus, so that the number of the recording process can be reduced. It is therefore possible to improve the productivity on a large scale.

Next, a second embodiment using an image receiving sheet having a cushion layer will be described below.

Figure 10:
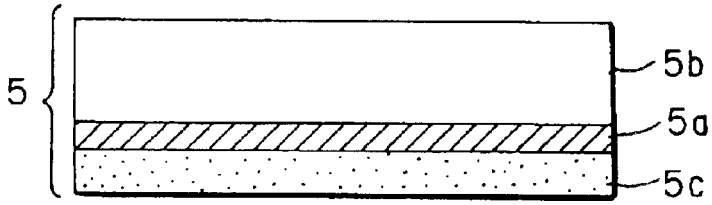
FIG. 10 is a sectional view showing a configuration of the image receiving sheet provided with a cushion layer.

A configuration of an image receiving sheet in this embodiment is shown in FIG. 10. An image receiving sheet 5 has not only an image receiving layer 5*a* and a substrate layer 5*b*, but also a cushion layer 5*c* provided outside the image receiving layer 5*a*. This cushion layer 5*c* has a function to absorb a surface unevenness appeared when toner is formed in a plurality of levels, or dusts are stuck thereon.

Figure 11:
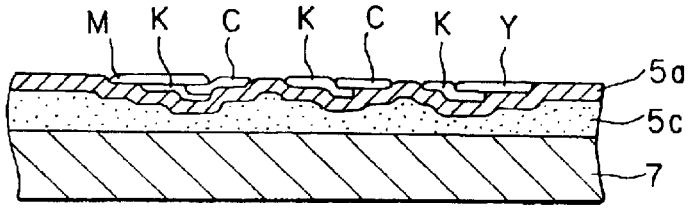
FIG. 11 is a sectional view showing a state after thermal transfer of four colors when the cushion layer is provided.
Figure 12:
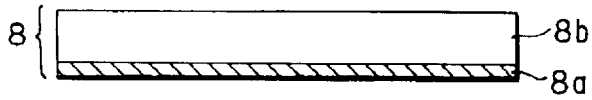
FIG. 12 is a sectional view showing a configuration of a protective sheet.
Figure 13:
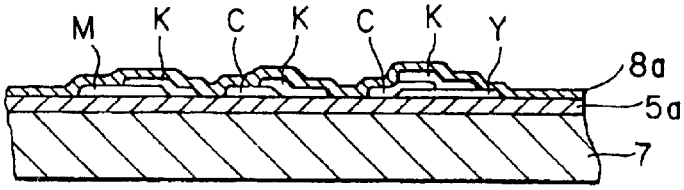
FIG. 13 is a sectional view showing a state where the protective layer is provided after thermal transfer of four colors, FIGS. 14(*a*) to (*f*) are schematic sectional views showing a related image recording process.
Figure 14:
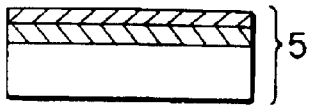
Figure 14:
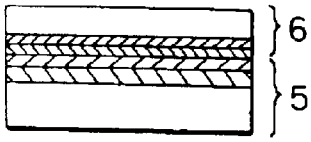
Figure 14:
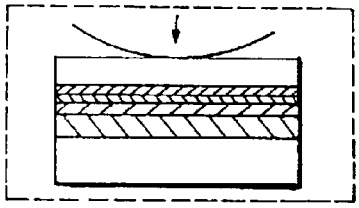
Figure 14:
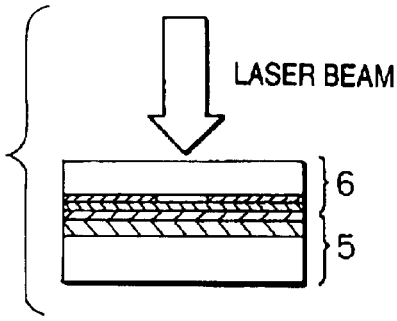
Figure 14:
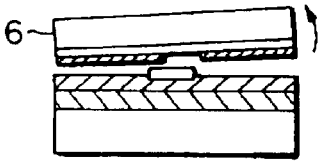
Figure 14:
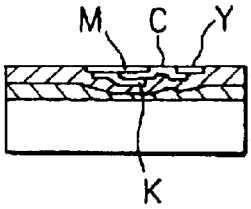

The image receiving sheet 5 having such a cushion layer 5*c* has a sectional shape as shown in FIG. 11 in the stage where image recording has terminated in the process similar to that in the first embodiment. That is, an image with toner of C, K, M and Y is recorded so as to be buried in the cushion layer 5*c* which is bonded on the recording paper 7. Accordingly, not only toner of the respective colors is bonded on the image receiving layer 5*a* surely, but also the surface unevenness is remarkably reduced. It is therefore possible to prevent toner separation or the like after toner transfer.

Next, a third embodiment in which a protective layer is transferred to the surface of the recording paper after transfer of four colors of K, M, C and Y will be described below.

This embodiment is intended to form a protective layer on the surface of the recording paper in the final step 16) of the first embodiment. This protective layer 8*a* is transferred by using a protective sheet 8 in which the protective layer 8*a* and a substrate 8*b* are formed integrally with each other. That is, the protective sheet 8 is wound on the recording paper 7 attached to the printing rotating-drum 2 so that the protective layer 8*a* of the protective sheet 8 is in contact with the recording paper 7, and then the protective sheet 8 is pressed from the outside by a not-shown roller. After the protective layer 8*a* is thus transferred to the recording paper 7, the substrate 8*b* is separated, so that the protective layer 8*a* is formed all over the recording paper 7.

Such a protective layer 8*a* may be formed in any manner such as directly spraying a known protectant to the recording paper 7. It is preferable to use a heating roller as the roller mentioned above in view of improvement of quality such as bonding strength, bonding reliability, and so on.

The provision of this protective layer 8*a* can prevent the surface of the recording paper 7 from being damaged when the recording paper 7 carrying four colors transferred thereto is brought into contact with a guide plate or is inserted between rollers in the image recording apparatus or another apparatus. As a result, it is possible to prevent the quality of the final image formed by thermal transfer of toner from deteriorating. In addition, it is possible to protect the state of the image from external effects, and keep the recorded high-quality image stable as it is immediately after recording.

Next, a fourth embodiment in which the focal position of laser light is adjusted accurately by use of an autofocus mechanism will be described.

Although it is not shown, the image recording apparatus in this embodiment is provided with a not-shown autofocus mechanism as a focal position adjusting means on the way of light path of laser beams, and further provided, on a movable stage 4, with a not-shown thickness detector, as a thickness detecting means, for detecting the thickness of recording paper 7 attached to a recording drum 2. The autofocus mechanism is operated in accordance with the output of the thickness detector. Accordingly, it is possible to adjust the focal position of the laser light to the position of a light-heat conversion layer 6*b* or a toner layer 6*c* of a toner sheet 6 with a high accuracy regardless of the thickness of the recording paper 7.

Usually, not only the thickness of recording paper 7 is different individually but also it slightly varies in accordance with the location of the recording paper 7. Therefore, the position of the light-heat conversion layer 6*b* or the toner layer 6*c* attached to the recording drum 2 varies in height in accordance with the variation of the thickness of the recording paper 7. As a result, the focal position of laser light is shifted so that the spot diameter is extended. Accordingly, the resolution of a recorded image is reduced so that the image quality deteriorates. In addition, the thickness may vary in accordance with change of temperature or humidity to thereby give an influence on the image quality.

In this embodiment, even if there is a variation in thickness of the recording paper 7 as mentioned above, the deviation or variation of the thickness is detected by the thickness detector on one hand, while the focal position is corrected by the autofocus mechanism on the other hand, so that the image quality is prevented from deteriorating.

Here, a well-known mechanism is available as the autofocus mechanism in this embodiment, and a well-known detector such as a laser displacement meter or the like is available as the thickness detector. It is preferable that the thickness detector is a non-contact displacement meter. In this case, it is possible to detect the thickness easily and accurately at a high speed.

The focal position may be adjusted by a method in which the thickness is detected partially or wholly in the outer circumferential surface of the recording drum, the obtained information of the thickness is once stored in a memory or the like, and then recording is performed while the focal position is adjusted in accordance with the thickness in each position.

Figure 15:
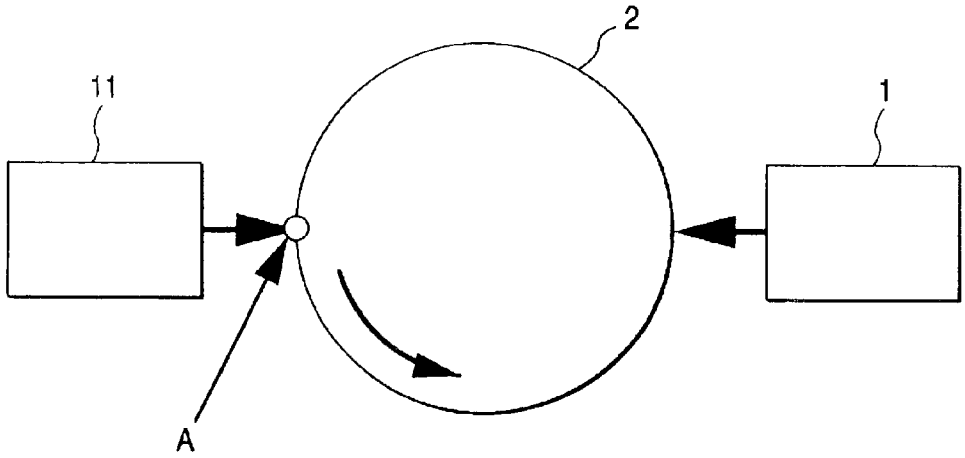
FIG. 15 is schemetic diagram showing another embodiment of the present invention.

Detection of the thickness and adjustment of the focal position may be performed simultaneously. For example, an optical head 1, a recording drum 2 and a thickness detector 11 are disposed as shown in FIG. 15. Now considering a case where the recording is conducted at a point A on a recording paper. First, the thickness detector 11 detects the thickness of the recording paper of the point A at a detecting position thereof. The detected result is processed by a control section (not shown) and a control value for adjusting the focal position of the optical head 1 is calculated. During the calculation, the point A is rotated to the vicinity of the recording position. The optical head 1 adjusts the focal position thereof in accordance with the control value in real time and exposes the point A when it comes to the recording position. According to this configuration, the time lag between the time to detect the thickness and the time to analyze the detection result can be canceled. Accordingly, it is possible to adjust the focal position in real time. According to this method, it is possible to perform image recording quickly without increasing the time for recording an image.

As has been described above, in the image recording method and image forming apparatus according to the present invention, a recording material constituted by an image receiving sheet having an image receiving layer on its one side and a toner sheet is attached on the outer circumferential surface of a recording drum, and the recording material is heated in accordance with character/image data for output, so that toner of the toner sheet is thermal transferred to the image receiving layer. Recording paper on which an image is to be recorded is attached on the outer circumferential surface of the recording drum, the toner is thermal transferred after the image receiving layer of the image receiving sheet is transferred to the recording paper, and the toner is thermal transferred directly to the image receiving layer transferred to the recording paper so that an image is recorded thereon.

As a result, not only it is possible to transfer toner onto the recording paper more accurately, but also it is not necessary to detach the recording material having an image recorded thereon from the image recording apparatus and attach it to another apparatus in order to transfer an image to the recording paper. Accordingly, the image recording process can be simplified, and the productivity can be improved on a large scale.

In addition, when a cushion layer is provided on the surface of the image receiving layer opposite to the toner transfer side, toner of the toner sheet subjected to laser exposure is transferred to the recording paper more surely. Further, when a protective layer is provided on the image recording surface of the recording paper after full-color transfer, the resistance against damage of the recorded image is improved, so that it is possible to keep the state of a high-quality image stably as it is at the time of printing.

In addition, it is possible to adjust the focal position of laser light to its normal position at any time regardless of scattering or variation in thickness of the recording paper. It is therefore possible to perform high-quality image recording without reducing the resolution of the recorded image.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. An image recording method comprising the steps of:

a) attaching recording paper on an outer peripheral surface of a recording drum;

b) attaching an image receiving sheet having an image receiving layer and a substrate, onto a surface of the recording paper to adhere image receiving layer on a surface of at least a whole of recording region of the recording paper;

c) separating the substrate such that only the image receiving layer is transferred onto the recording paper;

d) winding a toner sheet, provided as a cut sheet form, onto a surface of the image receiving layer; and e) transferring toner on the toner sheet onto the image receiving layer to record an image thereon in accordance with recording data, wherein all the steps a) through e) are performed on the recording drum, wherein a cushion layer is provided on a surface of the image receiving layer to face the recording paper and in physical contact with the surface of the recording paper.

2. The method or claim 1, wherein the image receiving layer is provided in a form of a cut sheet.

3. The method of claim 2, wherein each of said recording paper, image receiving layer and toner sheet are disposed one atop another along an outer circumferential surface of the recording drum, over at least half of the circumference of the recording drum.

4. The method of claim 1, wherein the recording paper is attached to the recording drum by suction.

5. The image recording method as set forth in claim 1, wherein the steps (d) and e) are repeated without providing any additional image receiving sheet, so that a color image is recorded on the image receiving sheet provided in the step b).

6. The image recording method comprising the steps of:

a) attaching recording paper to an outer peripheral surface of a recording drum;

b) attaching an image receiving sheet having an image receiving layer and a substrate, onto a surface of the recording paper to adhere the image receiving layer on a surface of at least a whole of recording region of the recording paper;

c) separating the substrate such that only the image receiving layer is transferred onto the recording paper;

d) winding a toner sheet, provided as a cut sheet form, onto a surface of the image receiving layer; and e) transferring toner on the toner sheet onto the image receiving layer to record an image thereon in accordance with recording data, wherein all the steps a) through e) are performed on the recording drum, wherein the image receiving sheet includes a cushion layer therebeneath, and the image receiving layer is transferred such that the cushion layer is placed between the surface of the recording paper and the receiving layer and in physical contact with the surface of the recording paper.

7. The image recording method as set forth in claim 1, wherein a protective layer is formed on an image recorded surface on the recording papers.

8. An image recording method for recording an image as set forth in any one of claims 1 and 6–7, wherein the steps of attaching recording paper, attaching an image receiving sheet, winding a toner sheet, and transferring toner are performed in a single apparatus.

* * * * *